United States Patent [19]

Adema et al.

[11] Patent Number: 4,780,899

[45] Date of Patent: Oct. 25, 1988

[54] CRYSTAL FOR AN X-RAY ANALYSIS APPARATUS

[75] Inventors: Cornelis L. Adema; Cornelis L. Alting; Wilhelmus H. J. M. Gevers; Albert Huizing, all of Eindhoven, Netherlands

[73] Assignee: U.S. Philips Corporation, New York, N.Y.

[21] Appl. No.: 852,051

[22] Filed: Apr. 15, 1986

[30] Foreign Application Priority Data

Apr. 24, 1985 [NL] Netherlands ..... 8501181

[51] Int. Cl.[4] ..... G21K 1/06

[52] U.S. Cl. ..... 378/84; 378/82; 428/426; 428/428; 428/446

[58] Field of Search ..... 378/70–72, 378/82, 84–85; 428/426, 428, 446

[56] References Cited

U.S. PATENT DOCUMENTS

| | | | |
|---|---|---|---|
| 2,853,617 | 9/1958 | Berreman | 378/84 |
| 3,400,006 | 9/1968 | Berning et al. | 428/428 |
| 3,772,522 | 11/1973 | Hammond et al. | 378/84 |
| 3,777,156 | 12/1973 | Hammond et al. | 378/84 |
| 3,927,319 | 12/1975 | Wittry | 378/85 |
| 4,078,175 | 3/1978 | Fletcher et al. | 378/72 |
| 4,084,089 | 4/1978 | Zingaro et al. | 378/84 |
| 4,180,618 | 12/1979 | Alpha et al. | 428/428 |
| 4,203,034 | 5/1980 | Carroll, Jr. | 378/85 |
| 4,365,049 | 12/1982 | Tsunoda et al. | 522/152 |

FOREIGN PATENT DOCUMENTS

| | | | |
|---|---|---|---|
| 0115892 | 8/1984 | European Pat. Off. | 378/84 |
| 1304868 | 1/1973 | United Kingdom | 378/84 |

OTHER PUBLICATIONS

"Focusing X-ray Monochromators of Si and Ge Crystals" by Frey et al. Journal of Applied Crystallography, vol. 7, pt. 2, 4/1/74.

"Reflecting Variable Bent Crystal Spectrometer" by Elion et al., Rev. of Scientific Instruments, vol. 33, no. 7, 7/1962.

"Use of Toroidal Monochromators . . . Ratios" by Furnes, Jr. et al., Nuclear Instruments and Methods, vol. 193, (1982).

*Primary Examiner*—Craig E. Church
*Assistant Examiner*—John C. Freeman
*Attorney, Agent, or Firm*—Paul R. Miller

[57] ABSTRACT

A crystal for an X-ray analysis apparatus is mounted on a carrier of an amorphous material whose bonding surface preferably obtains its desired geometry by grinding and polishing. Using a suitably transparent carrier, use can be made of a UV-curable type of adhesive which is irradiated through the carrier. The thickness of the layer of glue can be checked, if desired, via the same path. Because no disturbing background radiation is generated by an amorphous carrier, local irregularities are avoided, and better thermal adaptation of carrier and crystal material is feasible, such a crystal will contribute to a substantially higher resolution when used in an X-ray analysis apparatus.

11 Claims, 1 Drawing Sheet

CRYSTAL FOR AN X-RAY ANALYSIS APPARATUS

Figure 1:
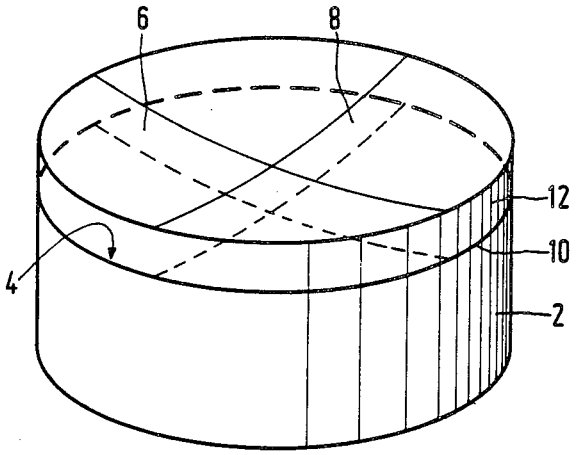

The invention relates to an X-ray crystal which is bonded to a carrier, and also relates to an X-ray analysis apparatus, including such a crystal.

Such an X-ray crystal is known from U.S. Pat. No. 2,853,617. The use of such an X-ray crystal in, for example an X-ray analysis apparatus which is also described therein, has drawbacks in that the surface smoothness of the crystal at its rear, that is to say the side of the crystal which is bonded to a carrier, is insufficient so that local irregularities occur at a crystal surface to be irradiated by an X-ray beam. These irregularities affect the analyzing or monochromatizing capability of the X-ray crystal. In known crystals problems are also encountered with X-rays which are reflected by the metal carrier of the crystal. Faults occur, for example in that the bonding process leads to local differences in the thickness of a bonding layer, for example a layer adhesive in that the surface of the carrier to be bonded cannot be smoothed sufficiently because, after mounting, deformations occur in the crystal, for example due to thermomechanical stresses, or because disturbing X-ray reflections occur from crystalline metal of the carrier. A known bonding method utilizes, for example sintered bronze which can absorb the superfluous adhesive because it is porous. However, sintered bronze grains often cause local irregularities and disturbing X-ray reflections. Undesirable reflections from the sintered grains or from the carrier material can be avoided by constructing the crystal so as to be comparatively thick; however, notably for crystals which are to be bent this has the drawback that the geometry of the crystal surface will deviate substantially from the desired geometry. Moreover, thermal deformation or crystal loosening will also be more problematic in the case of thick crystals.

It is an object of the invention to mitigate these drawbacks. To achieve this, an X-ray crystal of the kind set forth is characterized in that the carrier for the crystal is made of an amorphous material presenting a suitably workable surface.

Because the carrier in accordance with the invention is made of an amorphous material presenting a suitably workable surface, such as glass, glass ceramic or quartz glass, no X-ray reflections can occur therefrom, so that on the one hand this source of faults is eliminated and on the other hand, the thickness dimension of the crystal may be smaller. Further requirements imposed, such as deformability can thus also be better satisfied. The surface can be shaped, by example for milling, cutting, grinding and polishing.

The carrier in a preferred embodiment consists of an amorphous material, for example a type of glass whose coefficient of expansion does not deviate by more than a factor of approximately 2 from the coefficient of expansion of the material of the crystal, such as silicon or germanium. As a result, the crystal mounted on the carrier has a very high thermal stability and its shape is also very stable. A good example in this respect is a quartz glass carrier for a silicon or germanium crystal.

The carrier of a further preferred embodiment is made of a material which is transparent to ultraviolet radiation with the adhesive used for bonding being a UV-curable type. As a result, the thickness of the layer of adhesive can be highly uniform so that it will not be necessary to remove superfluous adhesive. Using an optical device, the thickness of the layer of adhesive can also be checked. Suitable bonding can also be obtained by insertion of an intermediate polythene foil.

The surface of the carrier to which the crystal is bonded in a further preferred embodiment is curved. The geometry of the carrier may be spherical, cylindrical, toroidal, etc. with the crystal itself then being flat; however, the crystal may also be, for example spherical or cylindrically concave. Examples in this respect are described in U.S. Pat. No. 2,853,617.

Figure 2:
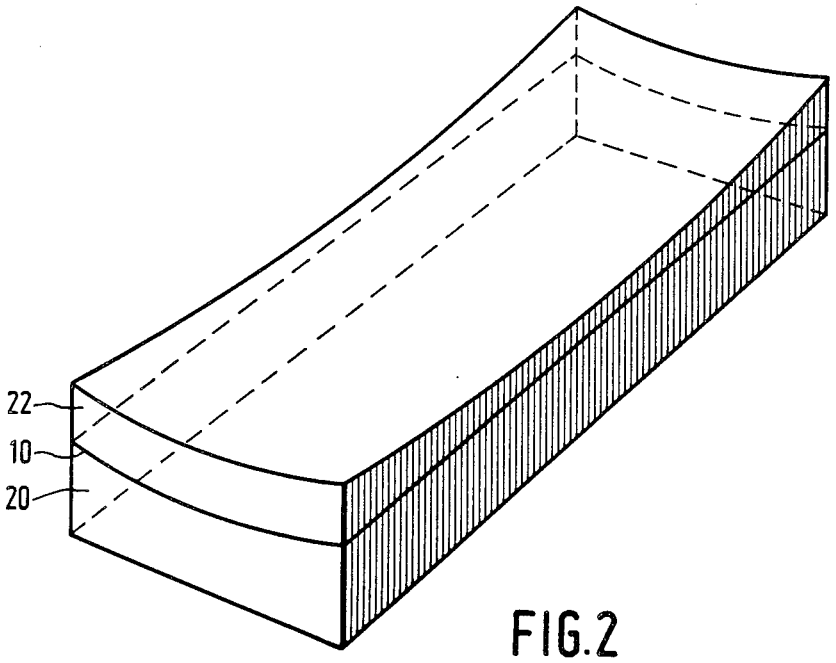

Some preferred embodiments in accordance with the invention will be described in detail hereinafter with reference to the drawing. Therein:

FIG. 1 shows a crystal in accordance with the invention, together with a concave carrier and a flat crystal plate, FIG. 2 shows a similar crystal with a concave carrier and a crystal plate which is also concave.

FIG. 1 shows a crystal carrier 2 which is made of, for example glass, glassy carbon, ceramic, glass ceramic etc. A surface 4 of the carrier 2 is ground so as to be, for example spherical, the radii of curvature of two mutually perpendicular arcs 6 and 8 being the same. Alternatively, the carrier may be ground so as to be toroidal; in that case the radii of curvature of the arcs 6 and 8 will not be the same, the difference being, for example a factor 2 as in the state of the art.

The radius of curvature of the carrier can be very exactly ground, for example with a deviation of less than 0.025 m from the desired shape. Contrary to, for example a milling operation, grinding does not involve a center point, so that this source of faults is also avoided. The surface roughness can be limited to, for example a maximum value of 0.005 $\mu$m over a distance of up to approximately 1 mm by the grinding operation.

In the case of a carrier which is transparent to ultraviolet radiation, the layer of adhesive preferably consists of a UV-curable type. For curing, the adhesive is irradiated by ultraviolet light through a carrier which is transparent to ultraviolet light. Curing can be uniform, so that an extremely homogeneous bonding layer is obtained. Like in known crystals, the type of adhesive used should be X-ray resistant. The checking of the uniformity of the layer of adhesive by means of ultraviolet radiation has already been mentioned. Such a check can be very accurately performed by means of an interferometer considering the thickness of the adhesive layer which in this case is in the order of magnitude of at the most a few wavelengths of the radiation used. For the adhesive layer use can also be made of a polymer. Again an extremely exactly defined thickness can thus be obtained and no problems will be encountered as regards superfluous material.

When the carrier is made of glass having a coefficient of expansion of approximately $5\times10^{-6}$, which is a customary value for many types of glass, the difference with respect to the coefficient of expansion of silicon, being approximately $2.5\times10^{-6}$, will be exactly a factor 2. In comparison with a difference of up to approximately a factor 10 of silicon or germanium in comparison with the metals commonly used for the carrier, such as copper and aluminium, a decisive gain is thus obtained as regards thermal stability. The crystal plate 12 which is mounted on a carrier which is in this case ground to be spherical, has a uniform thickness of, for example, 250 $\mu$m in the present embodiment. When the crystal plate is cut parallel to the crystal faces to be used for reflection, these faces and hence also the surface of the crystal plate which faces the X-rays will have the same spherical radius of curvature as the carrier. For other applications it will be advantageous to grind the crystal plate so as to obtain a radius of curvature of, for example, R with the crystal thus ground being mounted with its plane rear side in a jig which also has a radius of curvature R; when mounted in a jig, the crystal surface to be irradiated will then have a radius of curvature amounting to $\frac{1}{2}$R.

In FIG. 2, a crystal plate 22 which has a cylindrical recess is mounted, by way of example, on a carrier 20 which also has a cylindrical recess. The direction of the cylindrical recesses or the axes of the cylinders extend in a mutually orthogonal position upon mounting. Thus, a toroidal geometry is obtained for a crystal surface to be irradiated. A UV-curable type of adhesive and a carrier which is transparent to ultraviolet radiation can again be used and the layer of adhesive checked, if desired.

When used in an X-ray analysis apparatus, a crystal in accordance with the invention offers a higher resolution. This is mainly because of the fact that local irregularities in the crystal face structure are avoided and that the carrier does not produce disturbing background radiation. Notably in the case of bent crystals, the geometry can be more accurately adapted to the requirements to be imposed, because the crystal can be constructed to be thinner due to the uniform bonding layer, which can also be checked, and due to the absence of disturbing background radiation from the carrier and the improved thermal adaptation of the carrier and the crystal.

What is claimed is:

1. An X-ray crystal device for use with X-rays comprising a carrier of an amorphous material, said carrier being transparent to ultraviolet light, and said carrier having a shaped surface, and a crystal mounted on said shaped surface of said carrier by an X-ray resistant, UV-curable adhesive, wherein said carrier is one of glass, quartz glass, glass ceramic, and ceramic material.

2. An X-ray crystal device according to claim 1, wherein said carrier is of a material having a coefficient of expansion differing from a coefficient of expansion of said crystal by at most a factor of 2.

3. An X-ray crystal device according to claim 1 or 2, wherein said carrier is glass, and said crystal is one of Si or Ge.

4. An X-ray crystal device according to claim 3, wherein said crystal is bonded to said carrier by a polythene foil.

5. An X-ray crystal device according to claim 1 or 2, wherein said crystal has a surface bonded to said carrier to provide X-ray analysis, said surface deviating at most 0.025 $\mu$m from a predetermined geometric shape.

6. An X-ray crystal device according to claim 1 or 2, wherein said carrier is glass, and said crystal is one of Si or Ge.

7. An X-ray crystal device according to claim 6, wherein said crystal is bonded to said carrier by a polythene foil.

8. An X-ray crystal device according to claim 1 or 2, wherein said carrier has a surface bonded to said crystal, said surface having a surface roughness of less than approximately 0.005 $\mu$m.

9. An X-ray crystal device for use with X-rays comprising a carrier of an amorphous material, said carrier being transparent to ultraviolet light, and said carrier having a shaped surface, and a crystal mounted on said shaped surface of said carrier, wherein said crystal is mounted on said carrier by an X-ray resistant, UV-curable adhesive.

10. An X-ray crystal device according to claim 9, wherein said crystal has a surface bonded to said carrier to provide X-ray analysis, said surface deviating at most 0.025 $\mu$m from a predetermined geometric shape.

11. An X-ray analysis apparatus comprising means for analyzing X-rays, said means including a carrier of an amorphous material, said carrier being transparent to ultraviolet light, and said carrier having a shaped surface, and a crystal mounted on said shaped surface of said carrier by an X-ray resistant, UV-curable adhesive.

* * * * *